United States Patent [19]

Dennis

[11] Patent Number: 4,864,685

[45] Date of Patent: Sep. 12, 1989

[54] ONE PIECE HOSPITALITY STAIR BRACKET FOR RUGS

[76] Inventor: Louise L. Dennis, 2986 Ross Clark Cir., SW., Dothan, Ala. 36303

[21] Appl. No.: 158,904

[22] Filed: Feb. 22, 1988

[51] Int. Cl.[4] ..... A47G 27/04

[52] U.S. Cl. ..... 16/10; 16/8

[58] Field of Search ..... 16/8, 10, 11, 12, 13, 16/14, 15

[56] References Cited

U.S. PATENT DOCUMENTS

| | | | |
|---|---|---|---|
| 344,393 | 6/1886 | Mersereau | 16/10 |
| 720,447 | 2/1903 | Leslie | 16/10 |
| 3,745,606 | 7/1973 | Matthey | 16/10 |

FOREIGN PATENT DOCUMENTS

| | | | |
|---|---|---|---|
| 471111 | 8/1937 | United Kingdom | 16/11 |
| 697299 | 9/1953 | United Kingdom | 16/10 |

*Primary Examiner*—Fred A. Silverberg

[57] ABSTRACT

A brass stair bracket to fasten down oriented rugs/carpets edges on stairways. The bracket will reduce side-to-side movement of the rug, and it will reduce stress on carpet tack/staples as well as add to the decor. The new one-piece construction will aid installation and add sturdiness which will improve wear of the bracket. Since the bracket is installed near the crease of the stair, it should reduce any downward slipping of the carpet also.

1 Claim, 1 Drawing Sheet

ONE PIECE HOSPITALITY STAIR BRACKET FOR RUGS

BACKGROUND OF INVENTION

This invention relates to a stair bracket to fasten and reinforce rugs on stairways.

Heretofore, rugs were tacked or stapled down to stairways on the edges and in the crease of the stair. The unique features of the Hospitality Stair Bracket allow it to extend beyond the carpet edge further into the carpet to help keep the rug from slipping and pulling on the tacks. This bracket is installed near the crease of the stair to hold it snugly and also to add to the beauty of the installation. No prior stair bracket extends this length out over the carpet to hold it down so firmly. Or, no other stair bracket adds to the decoration of the stairway as strongly as the Hospitality Stair Bracket—as the pineapple is the symbol for "Hospitality." Also no previous stair bracket is made in this sturdy one-piece design to aid installation and long-term wear of the bracket.

SUMMARY OF THE INVENTION

The Hospitality Stair Bracket reduces the stress and pull on the tacks or staples in the rug. It also helps to keep the rug from slipping over to one side or the other.

The stair bracket, with it's beautifully carved pineapple designs, adds "warmth" and charm to even the "coldest" stairway.

DETAILED DESCRIPTION OF THE DRAWINGS

Figure 1:
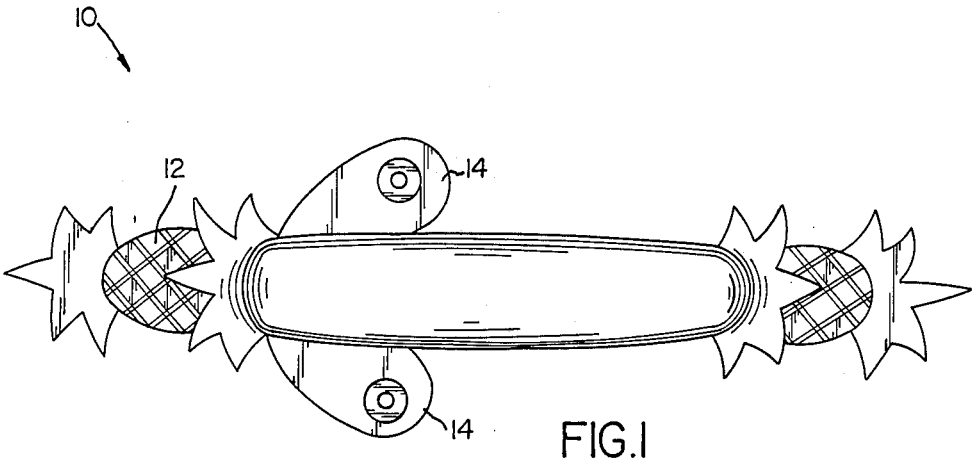
FIG. 1 illustrates the top view of the Hospitality Stair Bracket.

FIG. 1 is a top view of a Hospitality Stair Bracket and is designated by general reference numeral 10. The length measures 6⅜ inches on the top section. Carved pineapple designs 12 are featured on each end of this section of the bracket, and the construction is of ⅛ inch thick brass.

In this view, the bottom part 14 (which is screwed down to the stair/floor) is visible on each side of the top section. When the rug is slid up under the top section—this bottom part will not be visible, leaving only the long decorative part in view.

Figure 2:
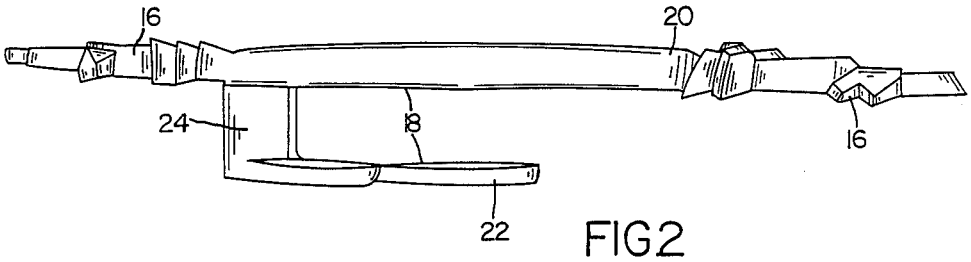
FIG. 2 shows the bracket from the side view.

FIG. 2 is a side view of a Hospitality Stair Bracket (with both sides being relatively the same). This view shows the decorative cut edges of the carved pineapples 16 on each end. The space 18 in-between the top and bottom pieces is where the oriental rug/carpet will be held in place. The brass brackets will be made with two widths in this space 18⅜ inch space for the thinner rugs and ⅝ inch space for the thicker ones. The long end 20 of the top section will come out over the rug to decorate and hold it down securely. The bottom piece 22 of the bracket measures 2⅜ inches in length. This piece is attached to the stair/floor with 2 brass screws. The connecting piece 24 measures approximately ⅝ inch square. The top and bottom pieces are approx. ⅛ inch thick.

Figure 3:
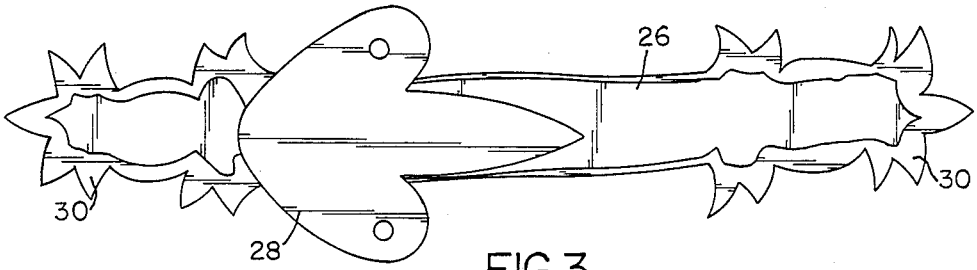
FIG. 3 is a view of the bottom of the bracket.

FIG. 3 is a bottom view of the Hospitality Stair Bracket. This view reveals that the underside of the top section 26 is somewhat hollowed out. The bottom piece 28 is solid and flat on the bottom. Also, you can see the pineapple design 30 cut on each end.

I claim:

1. A one-piece metal hospitality stair bracket for securing a rug near the crease of a stair comprising a top section having a top, an underside, a first and a second opposite end, a carved pineapple design having a top and an underside and extending outwardly from while being substantially parallel to each of said first and second ends, a connecting piece connected to the top section at said first end thereof, said connecting piece extending downwardly from the underside while also being substantially perpendicular to the top section, a bottom piece connected to said connecting piece at an end of said connecting piece farthest from the top section, said bottom piece having a length less than the length of the top section, said bottom piece extending form said first end toward said second end while also being substantially parallel to the top section, said bottom piece comprising an elongated section and two angularly directed sections, said angularly directed sections extending in an outward direction while also having holes thereon for receiving a screw, said underside of the top section and the carved pineapple designs being hollowed out, and said bottom piece being solid while also having a flat bottom.

* * * * *